US007467989B2

(12) United States Patent
Lin et al.

(10) Patent No.: US 7,467,989 B2
(45) Date of Patent: Dec. 23, 2008

(54) CERAMIC POLISHING PAD DRESSER AND METHOD FOR FABRICATING THE SAME

(75) Inventors: Hsiu-Yi Lin, Taipei County (TW); Chou-Chih Tseng, Taipei County (TW); Yu-Tai Chen, Taipei County (TW); Wei Huang, Taoyuan County (TW)

(73) Assignee: Kinik Company, Taipei (TW)

( * ) Notice: Subject to any disclaimer, the term of this patent is extended or adjusted under 35 U.S.C. 154(b) by 0 days.

(21) Appl. No.: 11/466,716

(22) Filed: Aug. 23, 2006

(65) Prior Publication Data

US 2007/0049185 A1 Mar. 1, 2007

(30) Foreign Application Priority Data

Aug. 24, 2005 (TW) ..... 94129005 A

(51) Int. Cl.
*B24B 53/00* (2006.01)

(52) U.S. Cl. ..... 451/56; 451/443; 51/307

(58) Field of Classification Search ..... 451/443, 451/444, 56, 72, 548; 51/293, 307, 308
See application file for complete search history.

(56) References Cited

U.S. PATENT DOCUMENTS 2,118,409 A * 5/1938 Loewy ..... 451/548
4,907,376 A * 3/1990 Bouchard et al. ..... 451/548
6,293,854 B1 * 9/2001 Kimura et al. ..... 451/56

* cited by examiner

*Primary Examiner*—Robert Rose
(74) *Attorney, Agent, or Firm*—Workman Nydegger

(57) ABSTRACT

A ceramic polishing pad dresser and the method for fabricating the same are provided. Abrasive particles are adhered onto a ceramic substrate by heating a ceramic powder to be vitrified, thus forming a ceramic diamond disk. Meanwhile, a plastic base is mounted on the bottom of the ceramic diamond disk. As for heating the ceramic powder to be vitrified, the ceramic powder with low melting point is disposed on the ceramic substrate, and to be heated to form a vitrified adhering layer, so as to adhere the abrasive particles disposed thereon to the ceramic substrate. The plastic base mounted on the bottom of the ceramic diamond disk is provided for bearing the ceramic diamond disk and has corresponding screw holes and positioning holes formed thereon for fitting the chemical mechanical polishing table to be mounted and reducing the manufacturing cost.

14 Claims, 5 Drawing Sheets

CERAMIC POLISHING PAD DRESSER AND METHOD FOR FABRICATING THE SAME

CROSS-REFERENCE TO RELATED APPLICATIONS

This non-provisional application claims priority under 35 U.S.C. § 119(a) on Patent Application No(s). 094129005 filed in Taiwan, R.O.C. on Aug. 24, 2005, the entire contents of which are hereby incorporated by reference.

BACKGROUND OF THE INVENTION

1. Field of Invention

The present invention relates to a ceramic polishing pad dresser and a method for fabricating the same, which are applied to a CMP or an abrasive polishing process, and more particularly to a ceramic diamond disk which employs ceramic as the substrate and has a plastic base.

2. Related Art

Diamonds, being one of the hardest known engineering materials, are usually used as super-abrasive for abrasive tools. For example, the polishing pad dresser used in the chemical mechanical polishing (CMP) process for fabricating semiconductor wafers or electromagnetic recording media, i.e. hard discs, is an abrasive tool with diamonds as abrasive particles. As the structure of the polishing pad dresser includes diamond particles adhered onto an abrasive particle junction surface of a disc shaped or ring-type metal substrate (or referred to as base metal), the abrasive tool for conditioning/dressing polishing pads is also called diamond disk.

For the structure of a diamond disk, conventionally, a diamond disk includes a metal substrate and diamond particles are fixed thereon by electroplating, sintering, or bonding agent layer for hard brazing. Metal material is easy to be corroded chemically, in the environment of strong-acid or strong-base slurry, the problems that the metal substrate or bonding agent layer may cause metal contamination to wafers and the diamond disk may has the risk of diamond falling due to metal corrosion are urgent to be solved. At present, researchers in the filed tend to using ceramic materials or plastic materials for the substrate of the diamond disk. For example, a sintered metal layer holding diamond particles is bonded to a substrate made of a plastic material, so as to solve the problem of chemical corrosion of the substrate. However, as the sintered metal layer exists, the high risk of contamination and diamonds falling due to chemical corrosion cannot be completely avoided. Another method of fabricating the diamond disk involves directly embedding the diamond particles into the ceramic powder of the substrate, sintering the ceramic powder by high-temperature, and finally removing the ceramic layer overlaid on the diamond particles, so as to expose the diamond particles out of the substrate and thus form a diamond abrasive layer on the ceramic substrate. Though the method can solve the aforementioned problem, the process is very complicated and the material cost is raised greatly as the overall material is ceramic. In another aspect, ceramic is quite hard, fragile, and difficult to be processed. A plurality of positioning holes or screw holes has to be formed at the back of the The diamond disk (i.e., another surface opposite to the diamond abrasive layer), so as to fit the CMP table to be mounted. However, as the ceramic material is hard and fragile, the forming the positioning holes or screw holes are difficult, and thus the manufacturing cost is increased.

SUMMARY OF THE INVENTION

In order to solve the above problem, the present invention provides a ceramic polishing pad dresser with a plastic base and a method for fabricating the same, so as to increase chemical corrosion-resistance of the diamond disk, which is simple and easy to be manufactured and has low manufacturing cost.

According to the ceramic polishing pad dresser with a plastic base and the method for fabricating the same provided in the present invention, abrasive particles are adhered onto the ceramic substrate by heating ceramic powder to be vitrified, thus forming a ceramic diamond disk. Then a plastic base is mounted on the bottom of the ceramic diamond disk. As for heating the ceramic powder to be vitrified, the ceramic powder with low melting point is disposed on the ceramic substrate to be heated to form a vitrified adhering layer, so as to adhere the abrasive particles disposed thereon to the ceramic substrate. The plastic base at the bottom of the ceramic diamond disk is provided for supporting the ceramic diamond disk and has corresponding screw holes and positioning holes formed thereon for fitting a diamond disk holder on the CMP table to be mounted. The material cost of the plastic base is lower than a metal base, and plastic material is simpler to be processed than ceramic material, so the manufacturing cost is reduced.

In order to the make aforementioned and other objects, construction, features, and functions of the present invention comprehensible, preferred embodiments accompanied with figures are described in detail below.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1A:
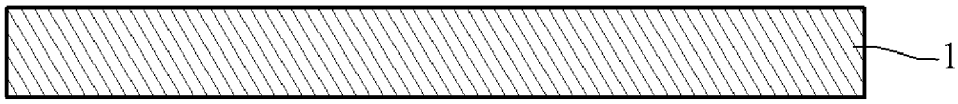
FIGS. 1A, 1B, 1C, 1D, 1E, and 1F are schematic views of fabricating the ceramic polishing pad dresser according to an embodiment the present invention.

Referring to FIG. 1A, according to the ceramic polishing pad dresser with a plastic base of an embodiment and the method for fabricating the same provided in the present invention, a ceramic substrate 1 is formed first in accordance with the desired product. For example, a diamond disk, applied in the CMP process for wafers or the abrasive polishing process for electromagnetic recording media, i.e. hard discs, is generally disc shaped (or other shapes, such as a ring or a stripe).

Figure 1B:
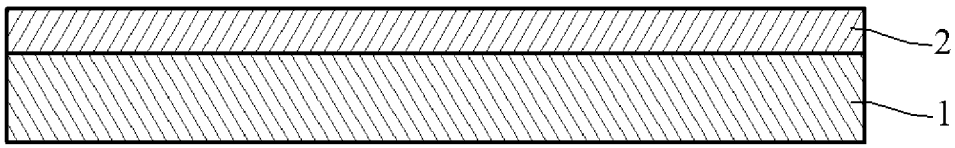

As shown in FIG. 1B, then a ceramic powder layer 2 of low melting point is coated on the ceramic substrate 1. The ceramic powder layer 2 includes ceramic powder of low melting point, (Si, Al, K are the main composition of the ceramic powder), for example, the ceramic powder is mainly consisting of silicon oxide, aluminum oxide, potash feldspar, calcium carbonate, barium carbonate, and so on.

Figure 1C:
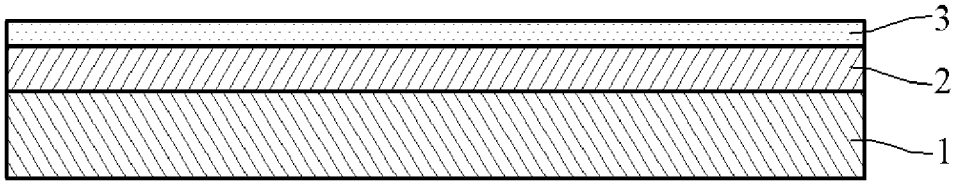
Figure 1D:
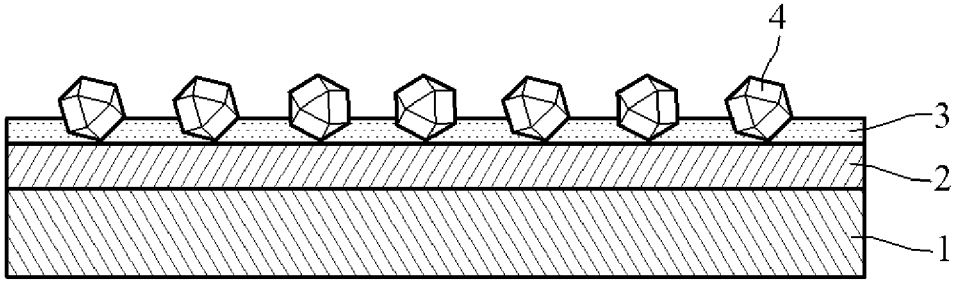

As shown in FIG. 1C, then, an adhesive agent layer 3 is coated on the ceramic powder layer 2 of low melting point by spraying.

Figure 2A:
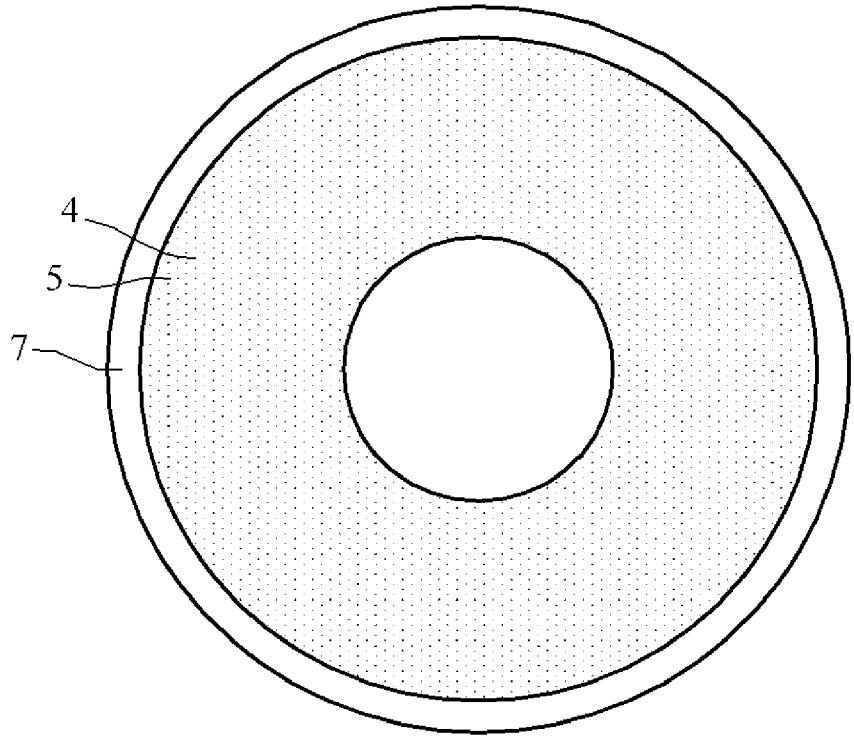
FIGS. 2A and 2B are front views of the shape of the abrasive layer on the ceramic polishing pad dresser according to the embodiment of the present invention.
Figure 2B:
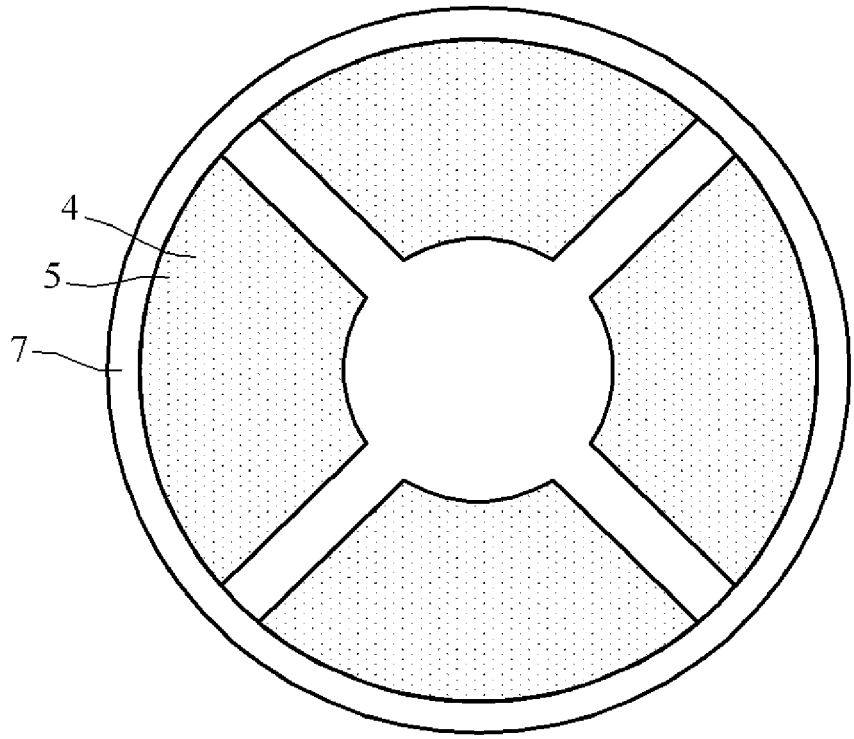

As shown in 1D, next, a plurality of abrasive particles 4 is disposed on the adhesive agent layer 3. The adhesive agent layer 3 is provided for fixing the abrasive particles 4 temporary, wherein the diamond-distributing region can have a round shape appreciably smaller than the ceramic substrate 1, and also a ring (as shown in FIG. 2A) or ring constituted of a plurality of sections (as shown in FIG. 2B) depending on the required shape of the diamond-distributing region of the desired product. The diamonds can be distributed by screen or template with preset patterns or by other appropriate conventional arts, and the details will not be described herein again.

The ceramic powder layer 2 of low melting point is mainly formed by ceramic powder, and the ceramic powder is difficult to be uniformly coated on the ceramic substrate 1. Therefore, the present invention provides a screen printing method to perform coating, which is mixing the ceramic powders of low melting point with printing oil and then coating the mixture onto the ceramic substrate 1 by screen-printing, such that the ceramic powder layer 2 of low melting point is uniformly formed on the ceramic substrate 1. In another aspect, a layer of adhesive agent can be coated on the ceramic substrate 1 first by powder scattering. The steps of coating adhesive agent and powder scattering can be repeated several times until reaching the predetermined thickness of the powder layer. Or, the ceramic powder is mixed with water in certain proportion, for example, 1:1 to form slurry, and then the slurry is sprayed onto the ceramic substrate 1. Another method of forming the ceramic powder layer is blade coating, so as to coat the slurry of a mixture of ceramic powder and water onto the ceramic substrate 1. Definitely, as for blade coating, the proportion of water must be reduced to prevent the flowing of slurry.

Then, the ceramic powder layer 2 of low melting point is preheated to about 700°~800° and remains the temperature for a period of time, for example, remains the temperature for 30 minutes, so as to sinter or partially melt the ceramic powder layer 2, thus firmly bonding the ceramic powder layer 2 onto the ceramic substrate 1. After that, the subsequent adhesive-spraying and diamond-distributing steps are performed.

Figure 1E:
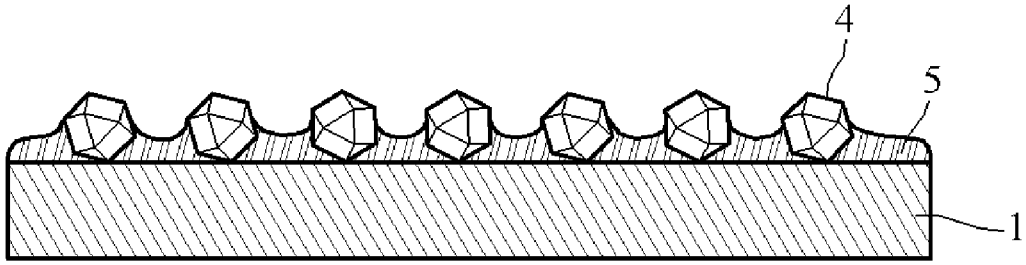

Referring to FIG. 1E, after the diamond-distributing process, the ceramic substrate 1 (ceramic diamond disk) is heated to 800°~1000° for a period of time, for example, for 5 hours, such that the ceramic powder layer 2 of low melting point is vitrified to form a vitrified adhering layer 5 to adhere a abrasive particle layer 4 onto the ceramic substrate 1. The melting point of the ceramic powder layer 2 of low melting point is lower than 1000°, so the ceramic powder layer 2 can be melted or partially melted at 800°~1000° to be vitrified. Compared with the ordinary ceramic sintering method, for example, aluminum oxide powder requires to be heated to 1200°~1600° to be sintered, the heating temperature of the ceramic powder layer 2 of the present invention is obviously much lower and the ceramic powder layer 2 can be heated by an air furnace (instead of vacuum or filling any gas atmosphere), such that the process can be achieved with an equipment that is low cost. Further, as the heating temperature is relatively low, the inevitable decaying of the strength of diamond material during the heating process is alleviated. Therefore, the strength of the diamond material remains at a high level, and thus the diamond material of the diamond disk are difficult to be broken in use.

Figure 3A:
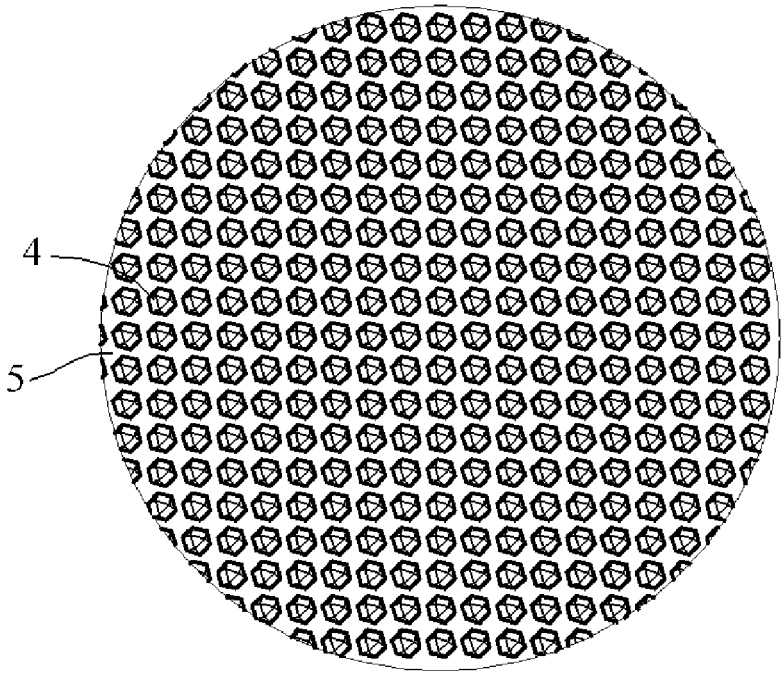
FIGS. 3A~3C are perspective views of the diamond-distributing patterns of the ceramic polishing pad dresser according to the embodiment of the present invention.
Figure 3B:
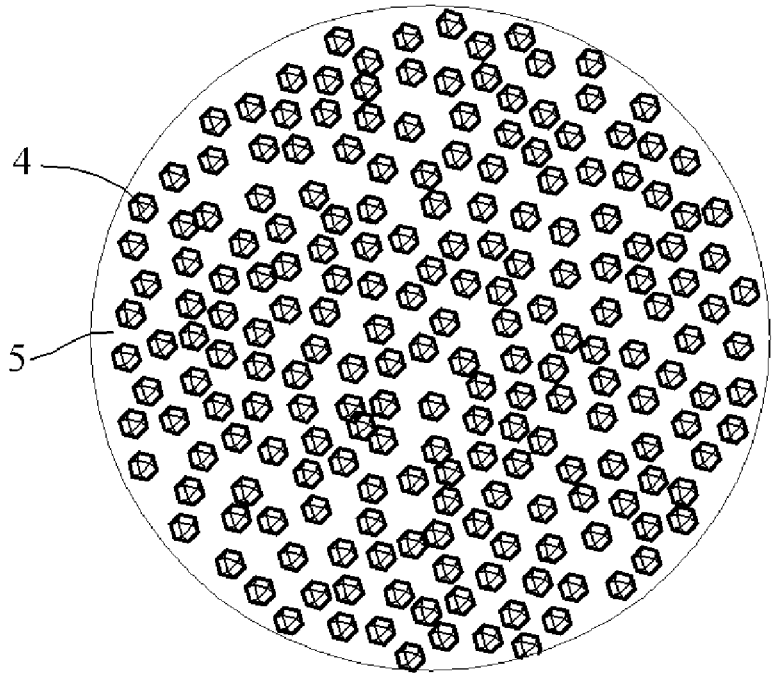
Figure 3C:
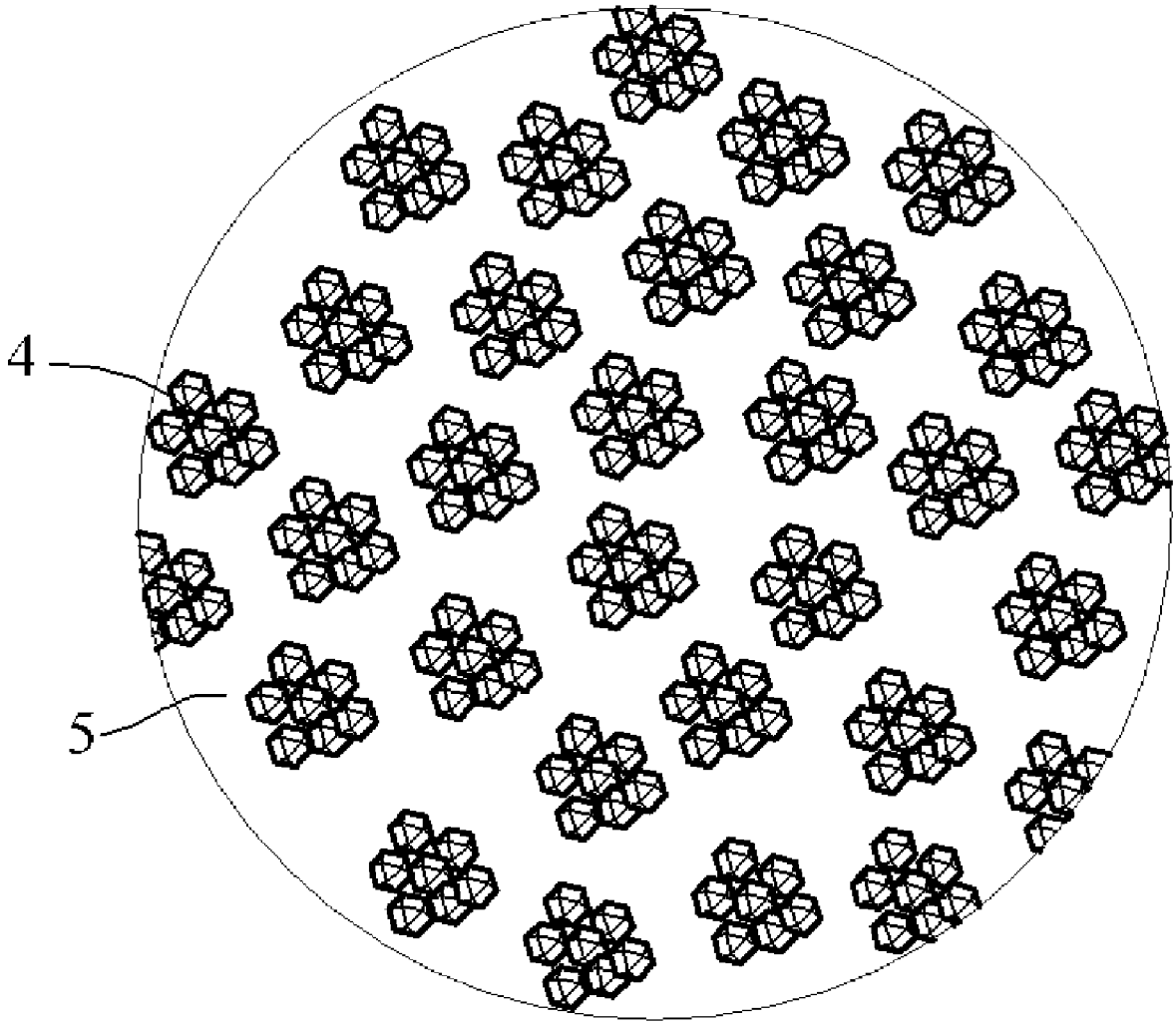

The abrasive particle 4, as required, can also SiC, $Al_2O_3$, ZrO, CBN, diamond abrasive, or a mixture thereof in a regular arrangement (as shown in FIG. 3A), irregular arrangement (as shown in FIG. 3B), or cluster arrangement (as shown in FIG. 3C). In order to avoid diamond shifting caused by the vibrating of the heating furnace or the melting of the ceramic powder layer 2 of low melting point in the ceramic diamond disk heating process, a ceramic platen can be disposed on the ceramic diamond disk, such that the ceramic platen presses against the diamonds by its own weight during the heating process for fixing the position of diamonds.

Figure 1F:
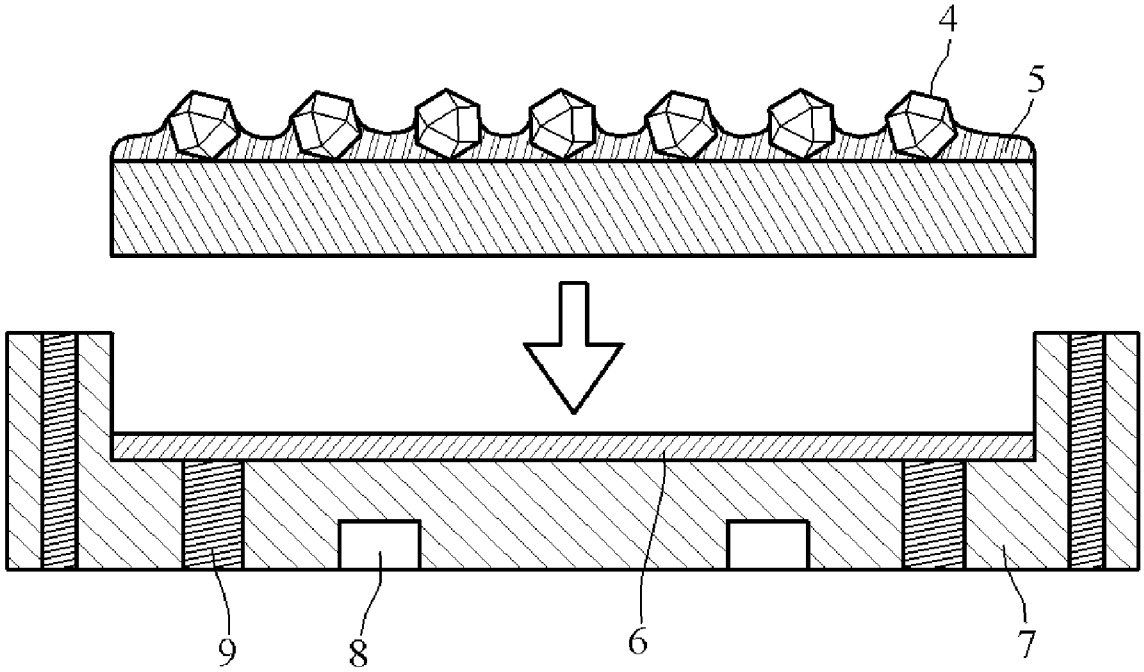

After the processes of heating and adhering abrasive particle 4, a plastic base 7 is mounted on the bottom of the ceramic diamond disk. The plastic base 7 has a containing depression in which an adhesive agent layer 6 is coated, and then the ceramic disk is fixed in the containing depression, as shown in FIG. 1F. The depth of the containing depression of the plastic base 7 is smaller than the thickness of the ceramic diamond disk after the bonding of the ceramic substrate 1 and the abrasive particle 4, such that the abrasive particles 4 can protrude from the containing depression for abrading. The plastic base 7, which can be made of industrial plastic (e.g., bakelite), does not only have the characteristic of chemical corrosion-resistance, but also is easy to be processed to form positioning holes 8 or screw holes 9 for fitting the diamond disk holder installed on the chemical mechanicial polishing (CMP) table later. Therefore, the material and manufacturing cost are significantly reduced. In general, the positioning holes 8 and screw holes 9 can be formed when the plastic base 7 is injection-molded or can be formed in the subsequent processing of the plastic base. The positioning holes 8 are used to be engaged by the protruding post of the diamond disk holder of the CMP table, and the screw holes 9 are provided for screws to be screwed into. Definitely, the position and size of the positioning holes 8 and screw holes 9 as shown in the figures are only for illustration. The relative thickness between the plastic base 7 and the ceramic substrate 1 can be designed according to the application field and conditions, and those as shown in the figures are only for illustration.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A ceramic polishing pad dresser, comprising:

a plastic base;

a ceramic substrate, disposed on the plastic base;

a vitrified sticking layer bonded to the ceramic substrate which is obtained by sintering a ceramic powder layer, wherein the melting point of the ceramic powder layer is lower than 1000° C.; and a plurality of abrasive particles, disposed in the vitrified sticking layer, such that the abrasive particles are adhered to the ceramic substrate via the vitrified sticking layer.

2. The ceramic polishing pad dresser as claimed in claim 1, wherein the plastic base includes a containing depression for receiving the ceramic substrate.

3. The ceramic polishing pad dresser as claimed in claim 1 wherein the abrasive particles are diamond particles.

4. The ceramic polishing pad dresser as claimed in claim 1, wherein the material of the abrasive particles is selected from the groups consisting of SiC, $Al_2O_3$, ZrO, CBN, and diamond.

5. The ceramic polishing pad dresser as claimed in claim 1, wherein the plastic base includes a plurality of positioning holes.

6. The ceramic polishing pad dresser as claimed in claim 1, wherein the plastic base includes a plurality of screw holes.

7. A method of fabricating ceramic polishing pad dresser, comprising:

providing a ceramic substrate;

forming a ceramic powder layer on the ceramic substrate, wherein the melting point of the ceramic powder layer is lower than 1000° C.;

disposing a plurality of abrasive particles on the ceramic powder layer;

heating the ceramic powder layer to a temperature between 800° C. and 1000° C., such that the ceramic powder layer is vitrified to form a vitrified sticking layer, such that the abrasive particles are disposed in the vitrified sticking layer and the vitrified sticking layer is adhered to the ceramic substrate; and disposing the ceramic substrate onto a plastic base after heating the ceramic powder layer.

8. The method of fabricating ceramic polishing pad dresser as claimed in claim 7, wherein the plastic base comprises a containing depression for receiving the ceramic substrate.

9. The method of fabricating ceramic polishing pad dresser as claimed in claim 7, wherein the ceramic powder layer is coated onto the ceramic substrate through mixing the ceramic powder with printing oil and by screen-printing.

10. The method of fabricating ceramic polishing pad dresser as claimed in claim 7, wherein the ceramic powder layer is formed by scattering powder.

11. The method of fabricating ceramic polishing pad dresser as claimed in claim 7, wherein the step for forming the ceramic powder layer includes mixing the ceramic powder with water into slurry, and spraying the slurry onto the ceramic substrate.

12. The method of fabricating ceramic polishing pad dresser as claimed in claim 7, further comprising a step of preheating the ceramic powder layer before disposing the abrasive particles on the ceramic powder layer.

13. The method of fabricating ceramic polishing pad dresser as claimed in claim 12, wherein the step of preheating the ceramic powder layer includes heating the ceramic powder layer to 700°~800° C. to be firmly bonded onto the ceramic substrate.

14. The method of fabricating ceramic polishing pad dresser as claimed in claim 7, further comprising a step of coating an adhesive agent layer on the ceramic powder layer before the abrasive particles are disposed on the ceramic powder layer.

* * * * *